US006766627B2

(12) United States Patent
Kotzur et al.

(10) Patent No.: US 6,766,627 B2
(45) Date of Patent: Jul. 27, 2004

(54) MACHINE FOR BOXING WOUND COILS OF FILAMENTARY MATERIAL

(75) Inventors: Frank W. Kotzur, Carmel, NY (US); David B. Franklin, Carmel, NY (US); Brian P. Moore, Newburgh, NY (US); Gregory A. Kotzur, Stanfordville, NY (US)

(73) Assignee: Windings, Inc., Patterson, NY (US)

( * ) Notice: Subject to any disclaimer, the term of this patent is extended or adjusted under 35 U.S.C. 154(b) by 0 days.

(21) Appl. No.: 09/853,862

(22) Filed: May 14, 2001

(65) Prior Publication Data

US 2003/0014942 A1 Jan. 23, 2003

(51) Int. Cl.[7] ..... B65B 63/04

(52) U.S. Cl. ..... 53/430; 53/118; 53/133.1; 53/458; 53/489; 53/566; 53/575; 53/581; 242/125.3; 242/164; 242/171

(58) Field of Search ..... 53/456, 458, 484, 53/485, 489, 566, 574, 575, 581, 376.3, 376.5, 377.3, 430, 118, 116, 133.1; 242/163, 164, 171, 125.3

(56) References Cited

U.S. PATENT DOCUMENTS 3,589,096 A * 6/1971 Podvin ..... 53/493
3,655,140 A * 4/1972 Gordon et al. ..... 242/477.4
3,677,490 A * 7/1972 Gordon et al. ..... 242/163
3,677,491 A 7/1972 Gerwig
3,748,817 A 7/1973 Newman
3,923,270 A 12/1975 Newman et al.
3,982,712 A * 9/1976 Bassett ..... 242/129
3,985,315 A 10/1976 Newman
4,019,636 A * 4/1977 Wise ..... 206/396
4,160,533 A 7/1979 Kotzur et al.
4,313,579 A * 2/1982 Zuber et al. ..... 242/163
5,150,789 A * 9/1992 Bass ..... 206/396
6,003,667 A * 12/1999 Barnett et al. ..... 206/396
6,276,623 B1 * 8/2001 Williams ..... 242/171

* cited by examiner

*Primary Examiner*—Eugene Kim
*Assistant Examiner*—Christopher R Harmon
(74) *Attorney, Agent, or Firm*—R. J. Lasker, Esq.

(57) ABSTRACT

A machine for winding and boxing wound coils of filamentary material having a payout hole extending from the outer to the inner coil winding, a turret mechanism mounting two oppositely disposed end forms and corresponding collapsible mandrels and operative between first and second stations, wherein the first station enables filamentary material to be wound on one of the mandrels and associated end form and a second station wherein the mandrel and end form containing the wound coil is rotated to confront a boxing station; a boxing station including a platform having a movable back panel, a base panel and an inclined ramp facing the second station and being movable towards and away from second station for receiving the wound coil from the collapsible mandrel; the boxing station receiving an unfolded box deposited on the base panel with a box back panel folded against the back panel and including means for folding two opposite side panels of the box to enable reception of the wound coil in the partially assembled box; payout tube inserting means for inserting a payout tube in the payout hole of the wound coil through a payout hole in the top panel of the box and including means for grasping the free end of the wound coil and withdrawing it through the payout tube; and the boxing station including means for folding, gluing and sealing the flaps of the box.

1 Claim, 15 Drawing Sheets

MACHINE FOR BOXING WOUND COILS OF FILAMENTARY MATERIAL

BACKGROUND OF THE INVENTION

1. Field of the Invention

This invention relates to apparatus for winding and boxing wound coils of filamentary material, and more particularly to such method and apparatus for automatically inserting a payout tube into a radial opening in a wound coil of filamentary material, threading an end portion of the filamentary material through the payout tube, inserting the wound coil into a container and securing the end of the withdrawn filamentary material on the container, and closing the flaps of the container, sealing the container and removing the container from the machine.

2. Related Art

The following patents each disclose container structure for retaining a wound coil of filamentary material for feedout through a radial opening in the wound coil and out of the container.

U.S. Pat. No. 3,677,491 to Gerwig discloses a package for a wind of flexible material and having end-forming flaps hinged about axes perpendicular to the axial opening of the wind. Truncated pyramids project inwardly from the end walls to control the unwinding of the coil and are formed by the folding of a blank of cardboard having extending flaps interleaved with the end flaps of the box to hold the pyramids in position.

U.S. Pat. No. 3,748,817 to Newman discloses a package of a compressed wind with the end walls substantially perpendicular to the longitudinal axis of the package.

U.S. Pat. No. 3,923,270 to Newman et al. discloses a package provided with tapering members within the axial opening to guide the individual coils of the material as they are withdrawn, in the space between the cone and the inner wall there is arranged a removable solid material which is held against the inside coils of the package.

U.S. Pat. No. 3,985,315 discloses a package for containing a wound coil with a funnel having a stem positioned in the radial opening and with the mouth thereof substantially at the midplane of the package.

U.S. Pat. No. 4,019,636 to Wise discloses a carton having a series of connected walls forming a perimeter around the coil and each of the walls has opposed hinged flaps. Tabs located on the edge of each flap opposite the hinged connection and the tabs on each side of the coil interlock to form a tapered boss extending into the open center of the coil spaced from, but facing, the like opposing boss.

U.S. Pat. No. 4,160,533 to Kotzur et al discloses a container having an octagonal insert and corner payout and includes a feedout tube inserted in the radial hole of the wind. Opposite sides of the insert engage the inner surfaces of the container. The bottom and upper surfaces of the container include intersecting cone sections for supporting the inner windings of the wound filamentary material.

As is evident from a consideration of the above prior art there is a need for improved method and apparatus for automating the packaging of wound coils.

SUMMARY OF THE INVENTION

It is a primary object of the present invention to provide a method and apparatus for automatically winding filamentary material on a mandrel and packaging the wound coils in a container and including a payout tube for paying out the wound coil through a radial opening in the coil and an aligned opening in the container for retaining the payout tube.

It is a primary feature and advantage of the present invention that a wound coil of filamentary material having a radial opening for receiving a payout tube and through which the wound filamentary material is withdrawn from an aligned opening in a container in which the wound coil is automatically packaged.

Yet another object of the present invention is to provide method and apparatus for loading a wound coil of filamentary material, having a payout hole extending through the coil from the outermost wind to the innermost wind, from a turret station where the filamentary material is wound, and for positioning the wound coil for movement of the wound coil to a boxing station.

It is a feature and advantage of the present invention that the wound coil with a payout hole is positioned for reception of a payout tube in the payout hole and the free end of the wound coil is secured to be subsequently grasped and pulled through the payout tube to the outside of the wound coil and the container.

It is another object, feature and advantage of the subject invention that, in a method and apparatus for automatically winding and packaging coils of filamentary material, a rotating turret mechanism is employed wherein the coil may be wound and then subsequently the wound coil is rotated into a position where the wound coil is located in a boxing station wherein the flaps of the container are folded around the wound coil and the payout tube is automatically inserted through an opening in the container and into the radial opening such that a free end of the coil is grasped and removed through the payout tube and the opening to the exterior of the container.

It is yet a further object of the present invention to provide both method and apparatus for automatically folding the flaps of a container around the wound coil and applying adhesive thereto to form the container.

It is yet a further feature and advantage of the present invention that the flaps of the container containing the wound coil of filamentary material are automatically glued and folded.

It is still another object of the present invention to provide both method and apparatus for automatically removing the packaged container of wound filamentary material from the packaging apparatus.

It is still another feature and advantage of the present method and apparatus that the container of wound filamentary material is automatically removed from the packaging apparatus.

The boxing machine of the present invention includes a rotating turret station where the coil of filamentary material is wound and then rotated and positioned at a payout tube insertion and boxing station wherein the various flaps of the container are folded around the wound coil. This station includes means for placing a payout tube into position for being inserted through a flap in the container and into the radial opening in the wound coil whereby an exposed end of the wound coil is grasped and removed through the payout tube to the exterior of the container. During this operation another coil is being wound at the opposite side of the turret for subsequent rotation to the payout tube insertion and boxing station. Various sensors provide signals to a programmer for controlling the winding of the coil, the movement of the turret, the operation of the payout tube insertion operation and the gluing and folding of the various flaps of the container to form the box enclosing the wound coil.

BRIEF DESCRIPTION OF THE DRAWINGS

The above objects, features and advantages are readily apparent from the following description of a preferred embodiment of the best mode for carrying out the invention when taken in conjunction with the following drawings, wherein.

Figure 4:
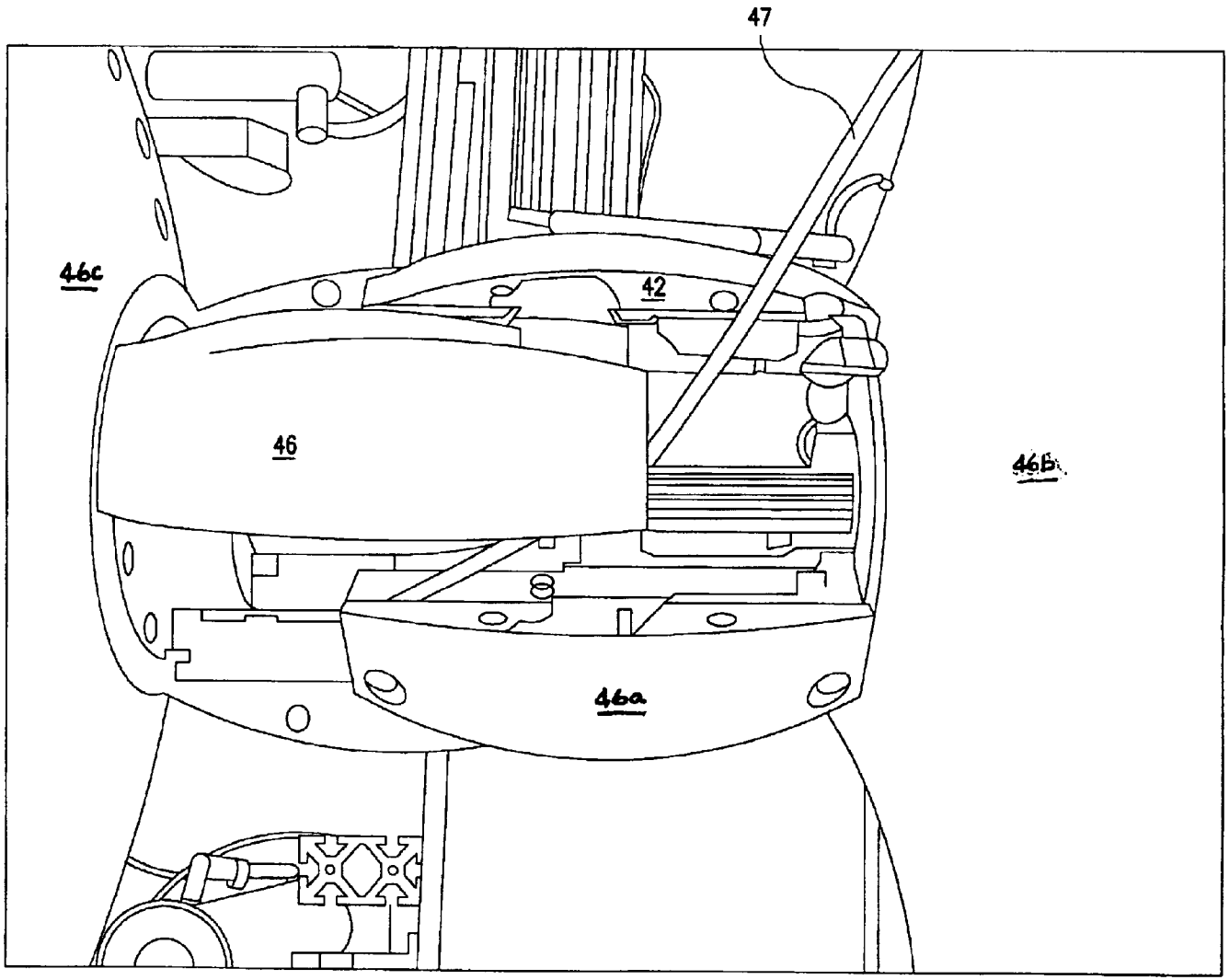
Figure 5:
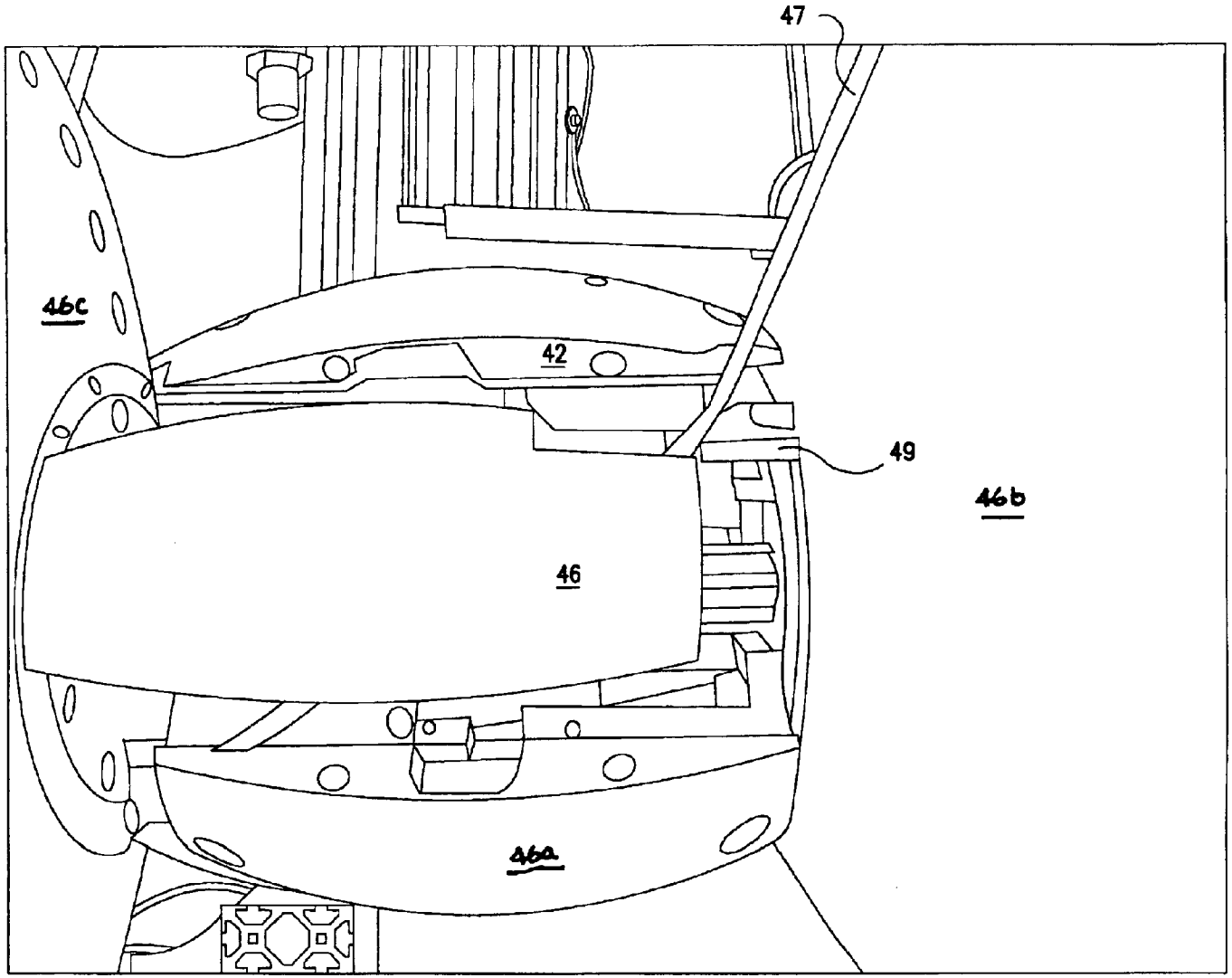
Figure 6:
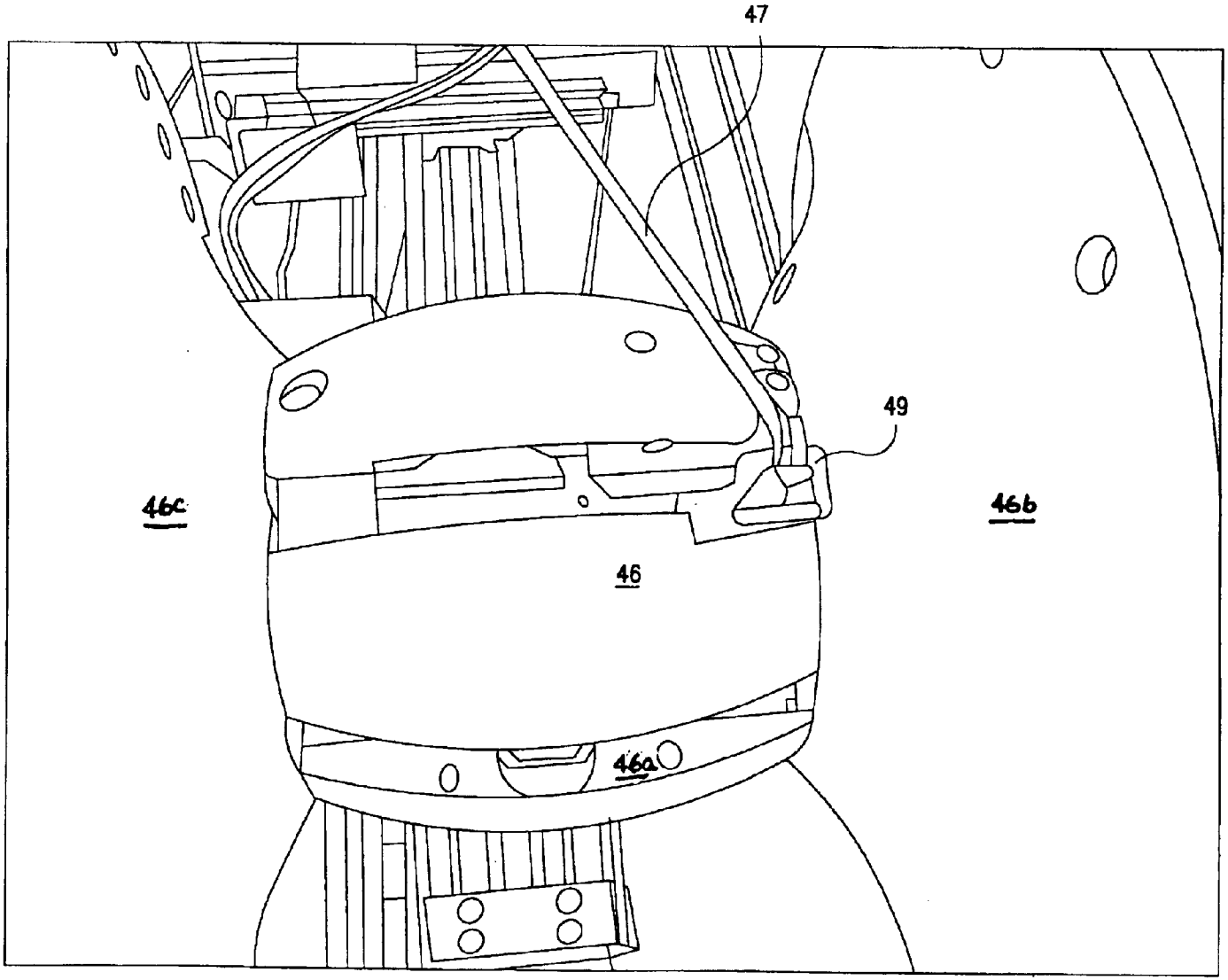
Figure 7:
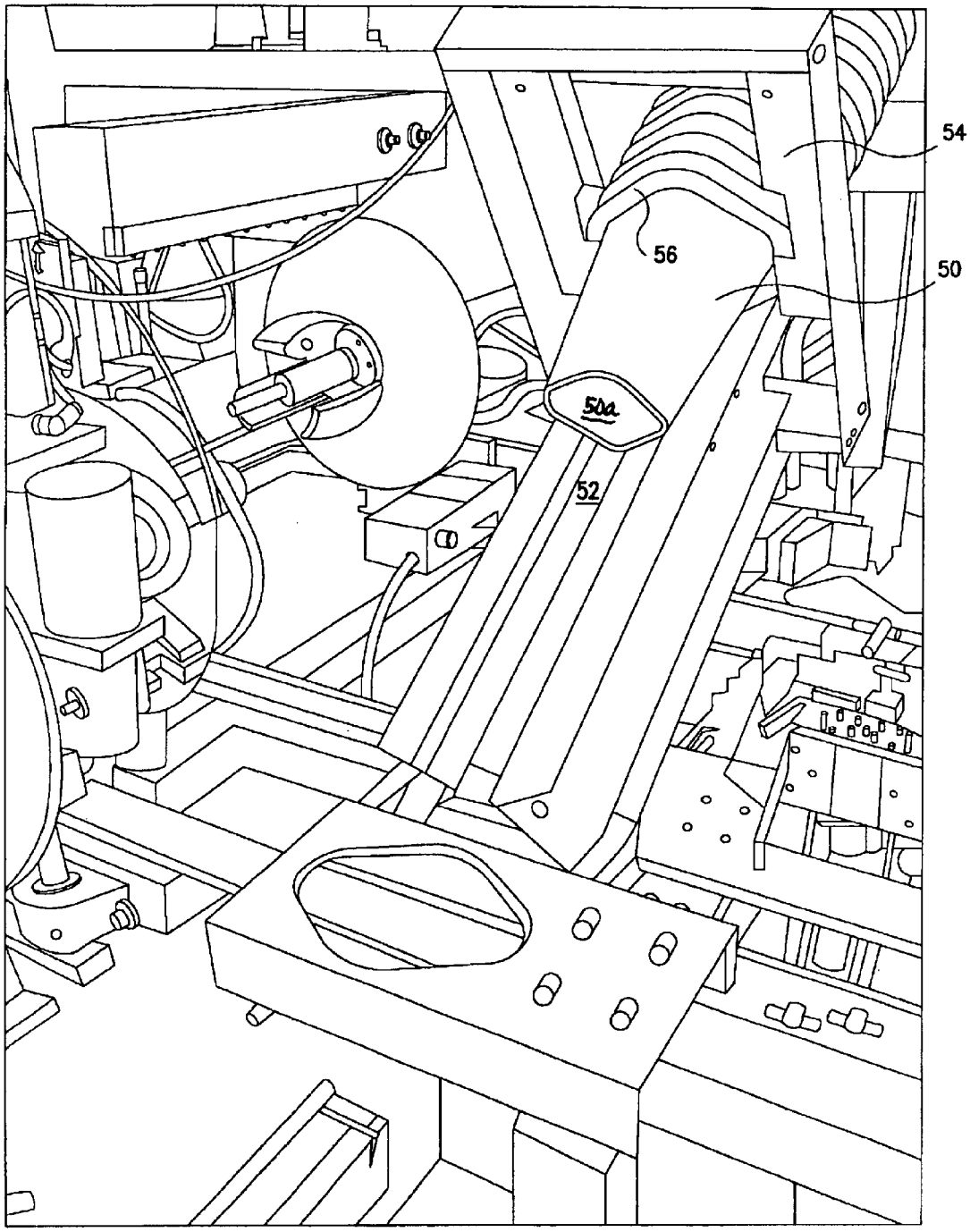
Figure 8:
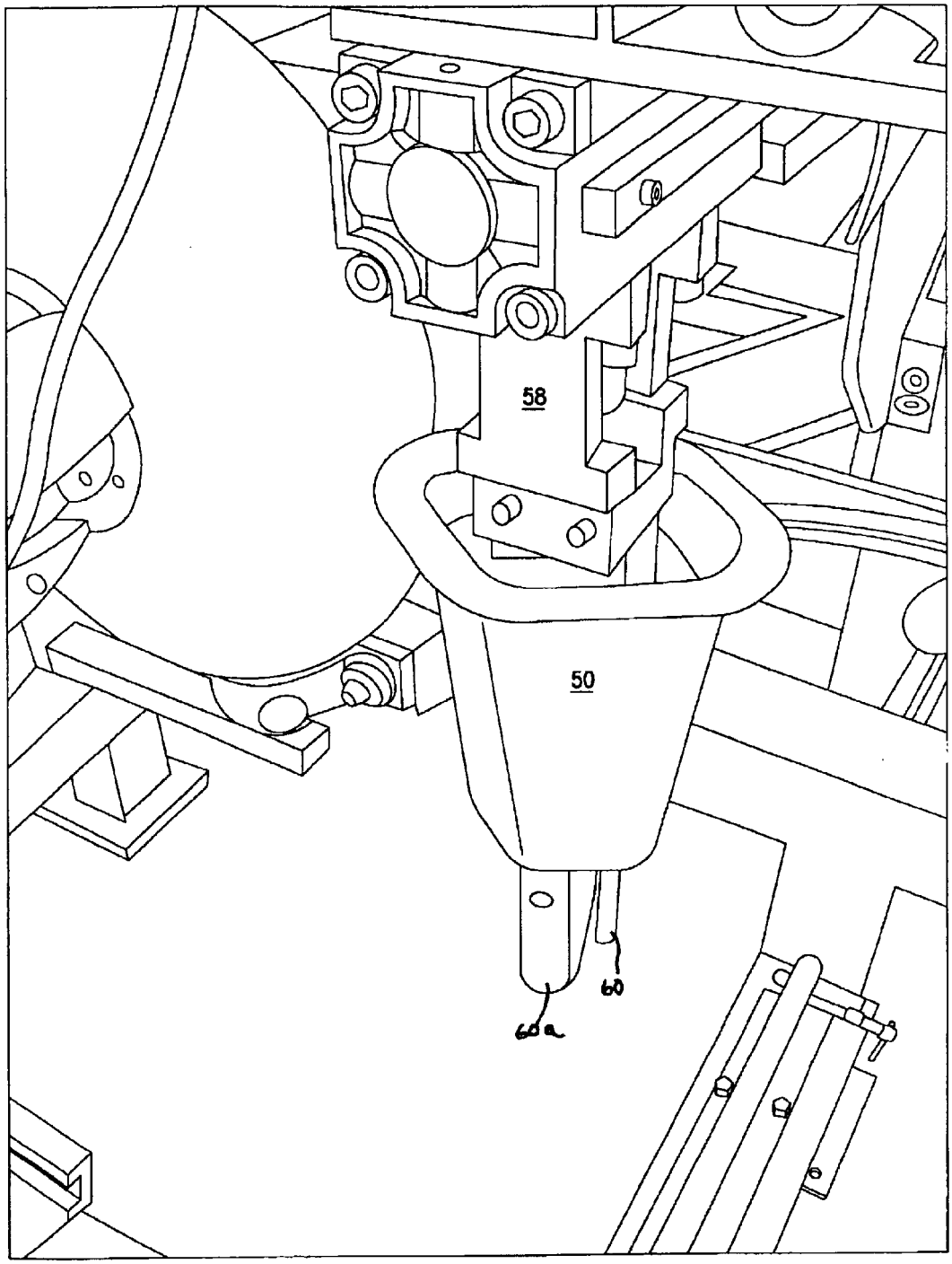
Figure 9:
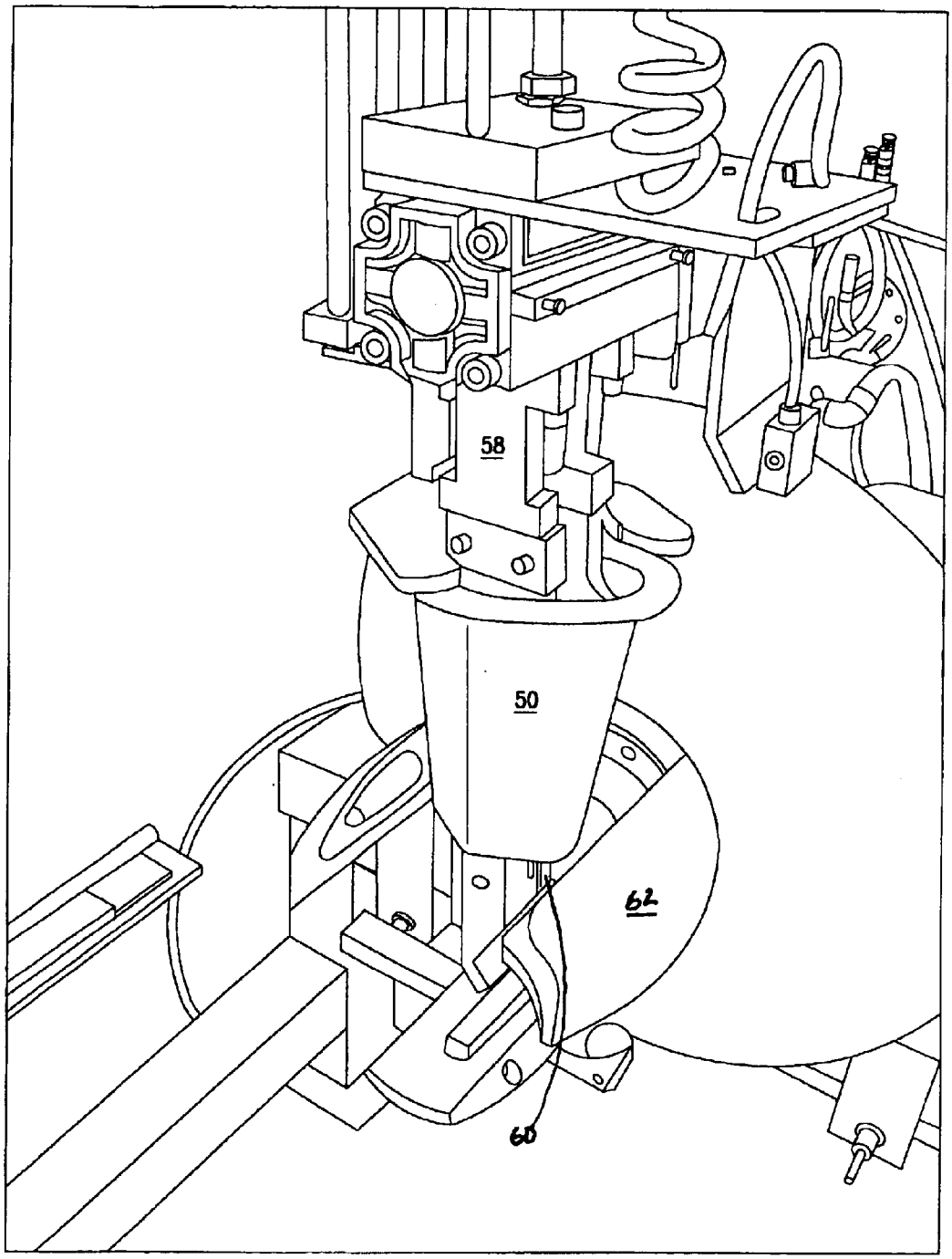
Figure 10:
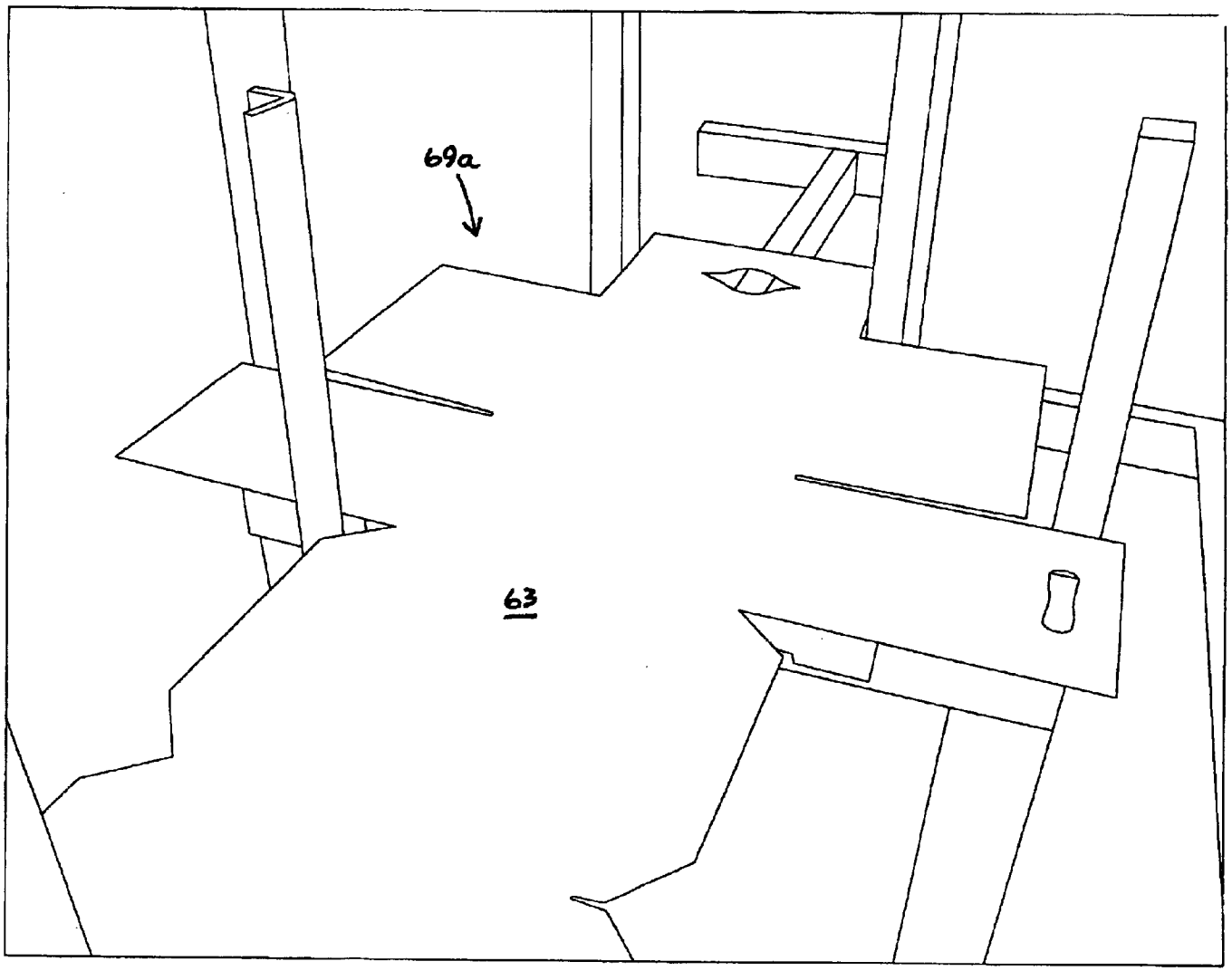
Figure 11:
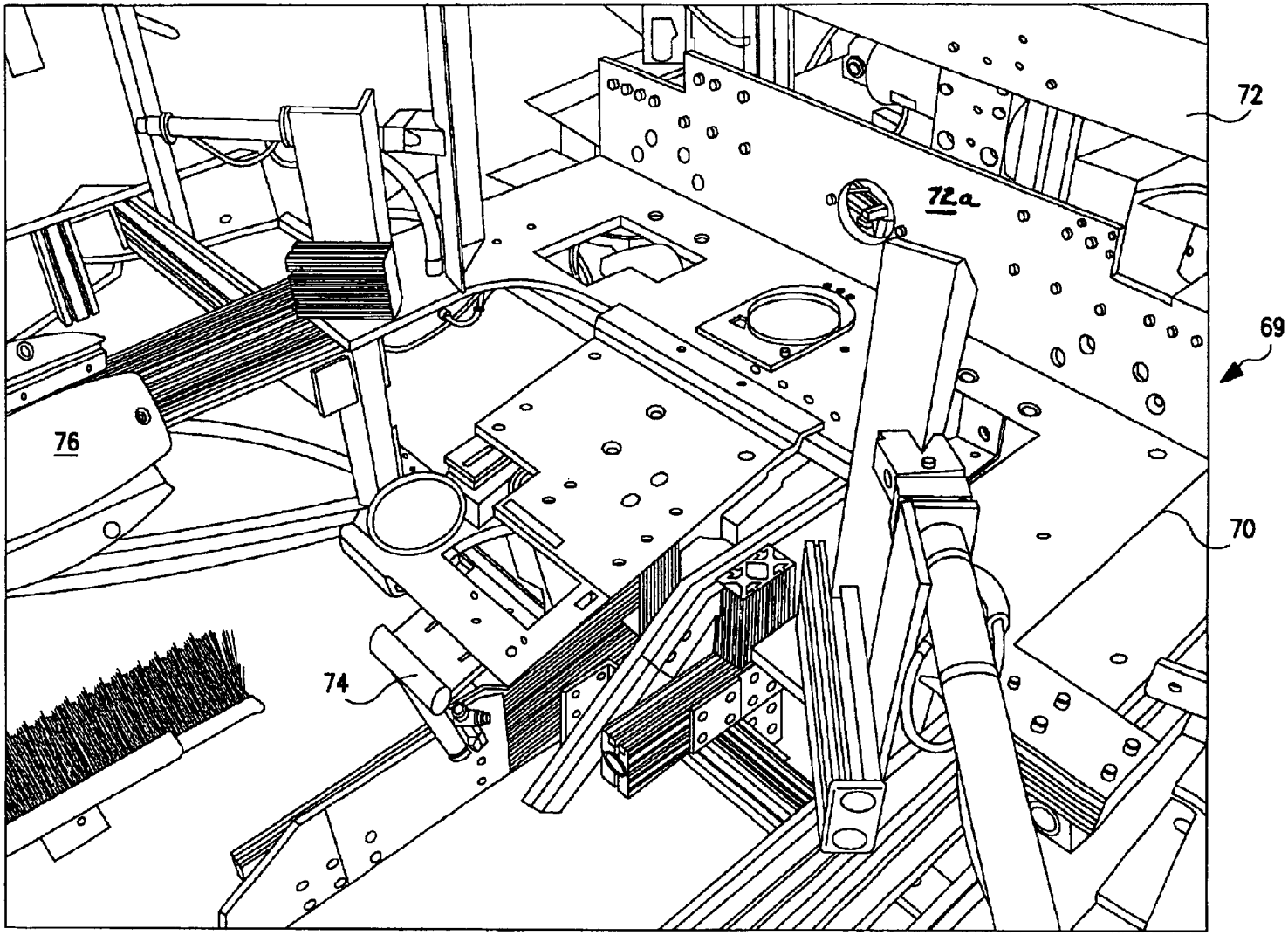
Figure 12:
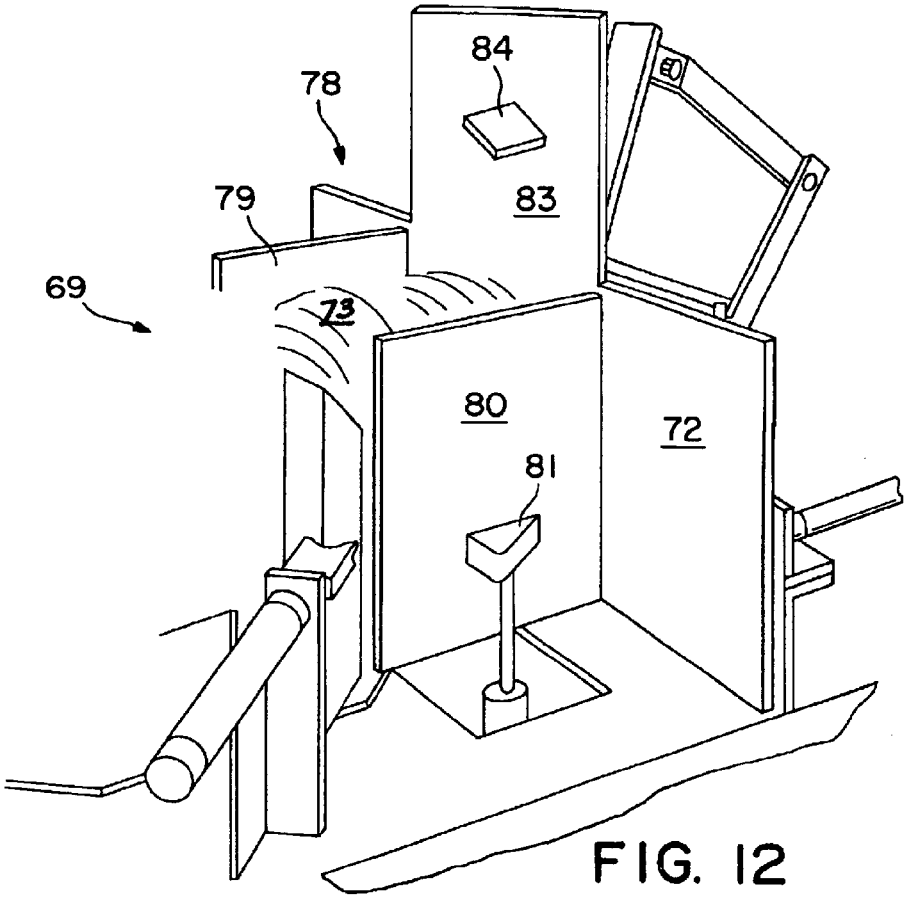
Figure 13:
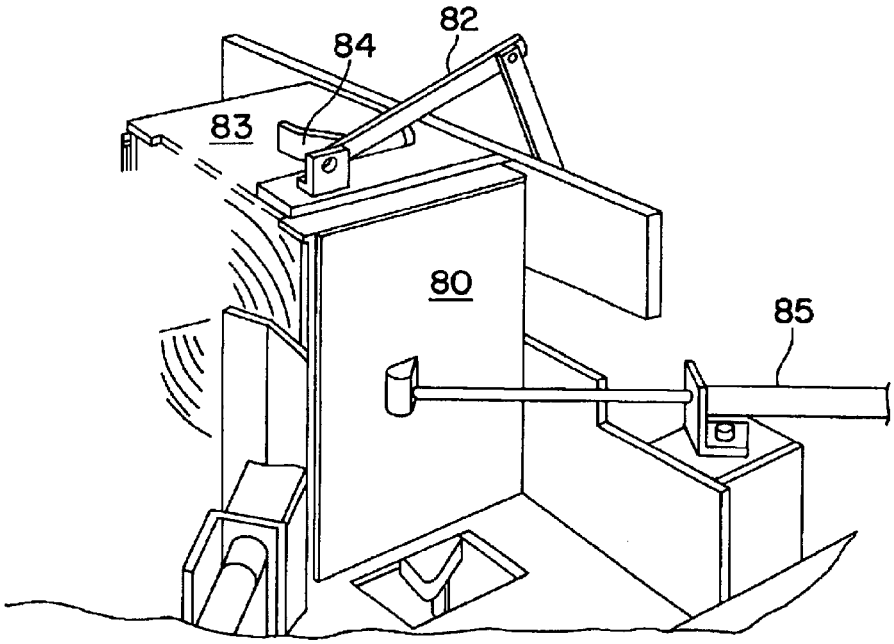
Figure 14:
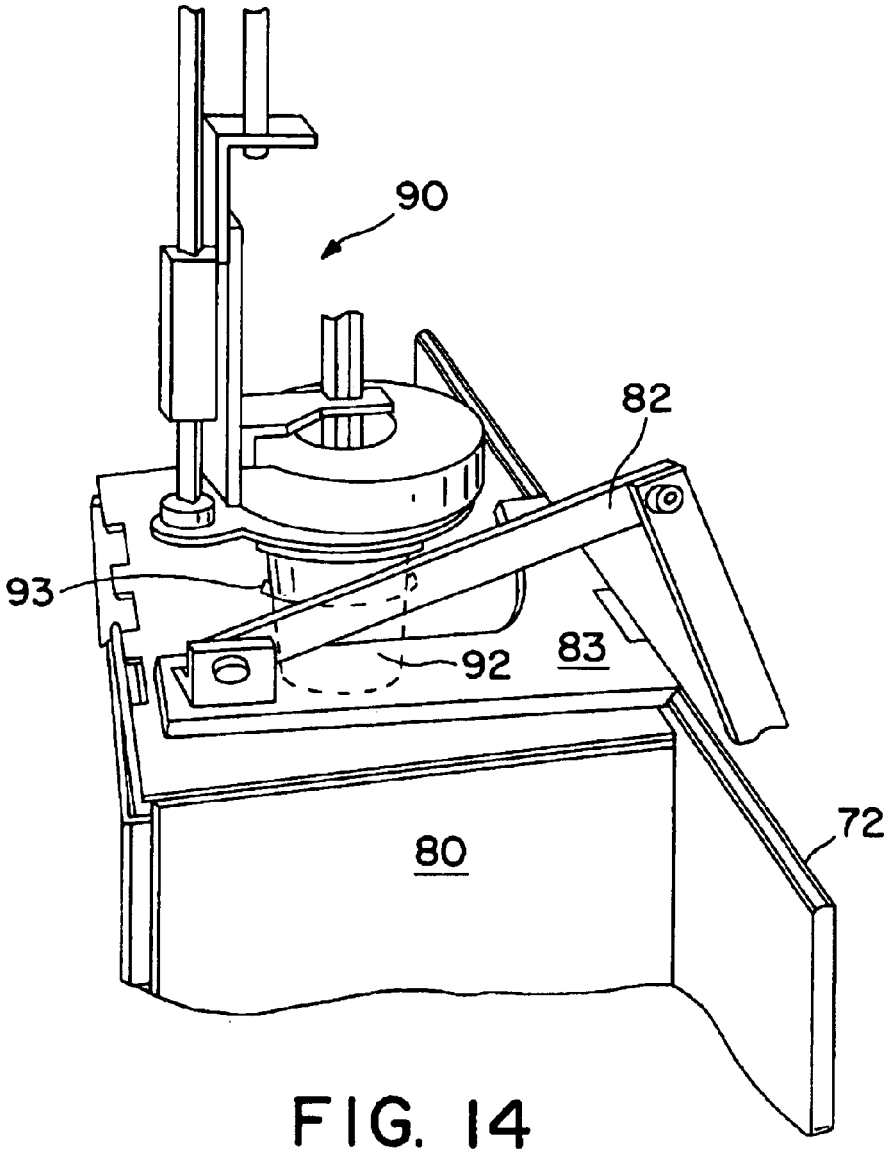
Figure 14A:
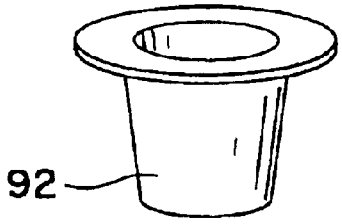
Figure 15:
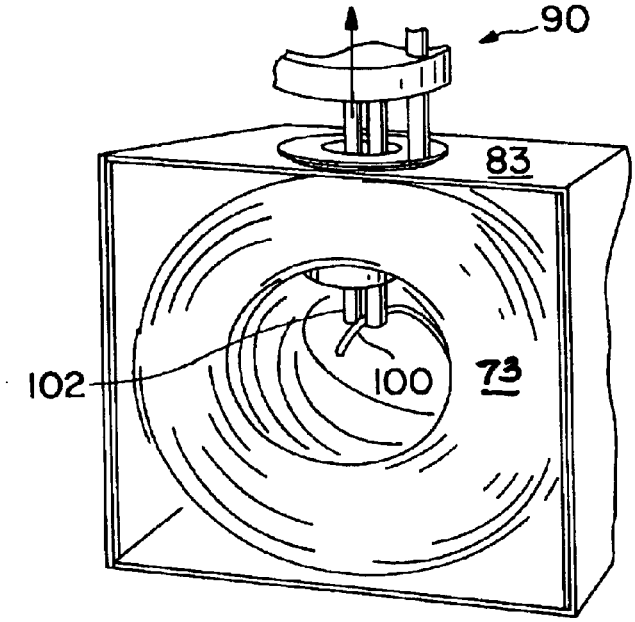
Figure 16:
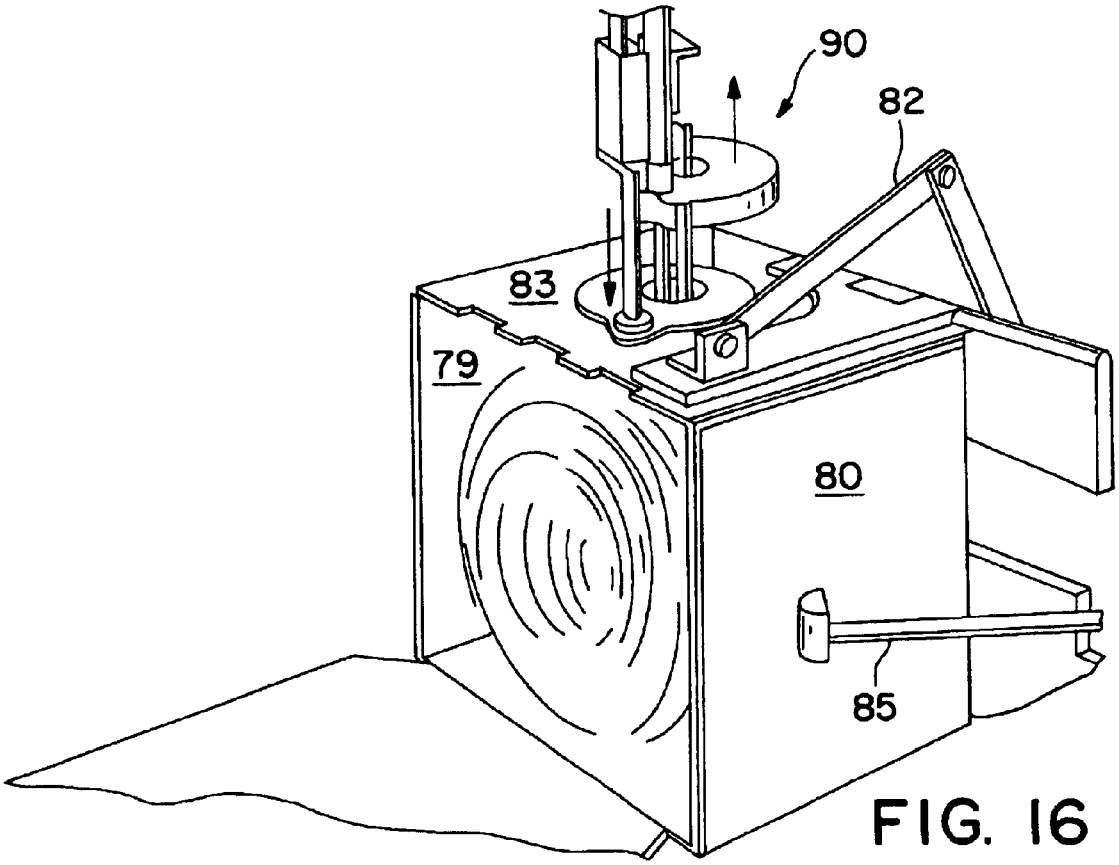
Figure 17:
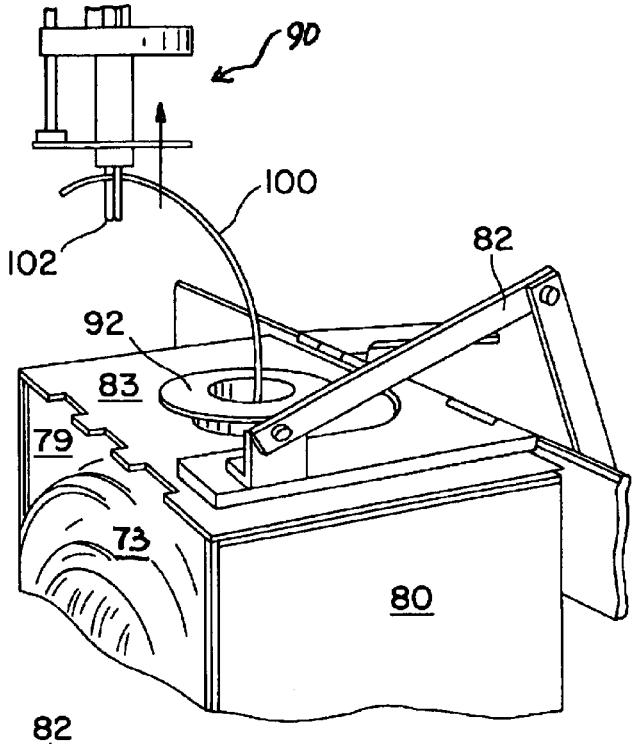
Figure 18:
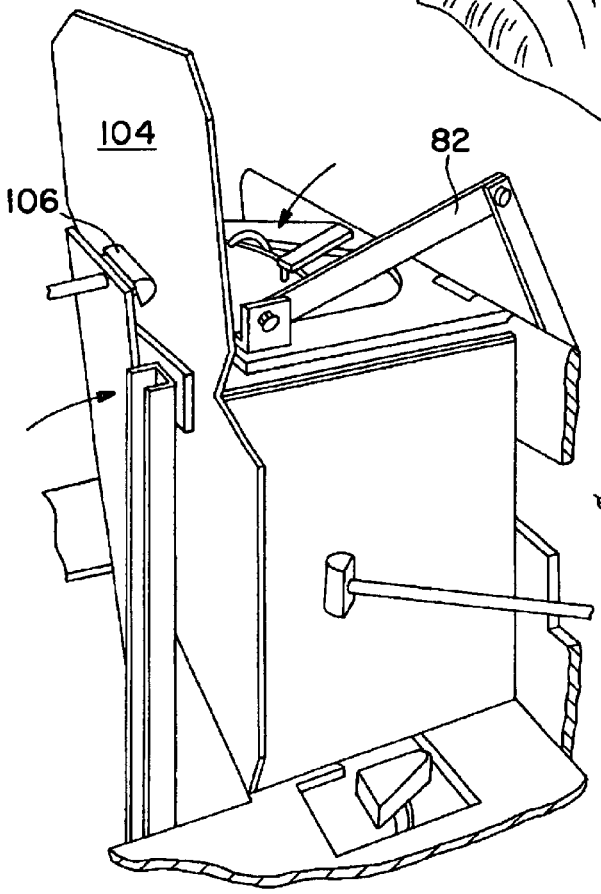
Figure 19:
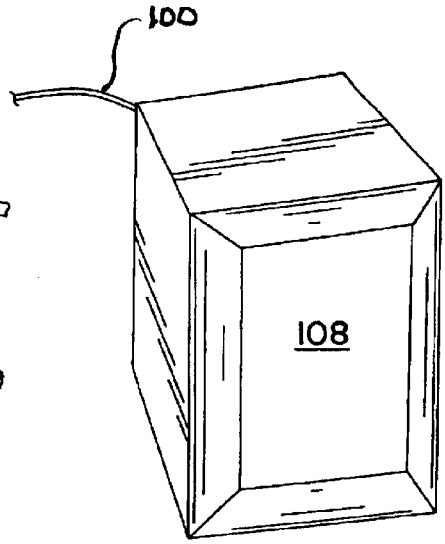

FIG., 3 shows the filamentary material grasped by the jaws of the clamp which are now closed;

FIG. 4 illustrates the entry of the collapsible mandrel on the opposing mandrel and end form which is being moved into interleaving relationship with the mandrel and end form illustrated in FIGS. 5 and 6 and whereby the filamentary material is being pushed toward the latching mechanism on the first mentioned end form, with the collapsible mandrels being further engaged as the second collapsible mandrel is pushed further into engagement with the first mentioned collapsible mandrel and the filamentary material firmly engaged in the latch at the base of the end form and with the collapsible mandrels fully engaged;

FIG. 7 is a perspective view of the payout tube supply source;

FIG. 8 illustrates the insertion payout tube holding structure, including the filamentary grasping component;

FIG. 9 illustrates the payout tube insertion and filamentary material grasping mechanism in relation to the mandrel but absent the wound coil for purposes of clarity;

FIG. 10 illustrates the container magazine storage station of the boxing apparatus of the invention;

FIG. 11 shows the boxing station which receives individual containers and the individual wound coils for boxing and which includes the necessary movable components to rotate the container flaps and gluing mechanism to enclose the wound coil in a completely formed container;

FIG. 12 shows the wound coil positioned in the partially formed container by rotation of the end form and mandrel on which the filamentary material was wound (not illustrated for clarity);

FIG. 13 shows the top panel of the container containing the payout tube opening being placed over the coil;

FIG. 14 shows the payout tube insertion mechanism being inserted in the payout tube opening in the top panel of the container and into the payout tube of the wound coil of filamentary material; and FIG. 14A is detail view of the payout tube;

FIGS. 15 and 16 illustrate the manner in which the end of the wound coil is grasped by the payout tube insertion mechanism and withdrawn from the wound coil and the container (FIG. 18) as the top panel is restrained from movement;

FIG. 17 illustrates the complete withdrawal of the payout tube insertion mechanism from the wound coil and the container while grasping the free end of the wound coil;

FIG. 18 illustrates the top closure panel of the container positioned to be formed over the top of the container; and FIG. 19 illustrates a completely sealed container.

DETAILED DESCRIPTION

The boxing machine of the present invention includes a filamentary material winding station 30 in which an end form 32, including a collapsible mandrel 33, is positioned in opposing operating relationship to a second end form 34, including a collapsible mandrel (not shown) is mounted to a rotating turret assembly 36, which also includes a third end form and an associated collapsible mandrel 39. The wound coil 40 is shown having been wound on the collapsible mandrel 33, end form 32, 34 structure by a winding mechanism well known to those skilled in the art. For an example of the coil winding process and machinery see Windings' U.S. Pat. Nos. 4,741,495, 5,413,264 and 5,678,778.

Figure 1:
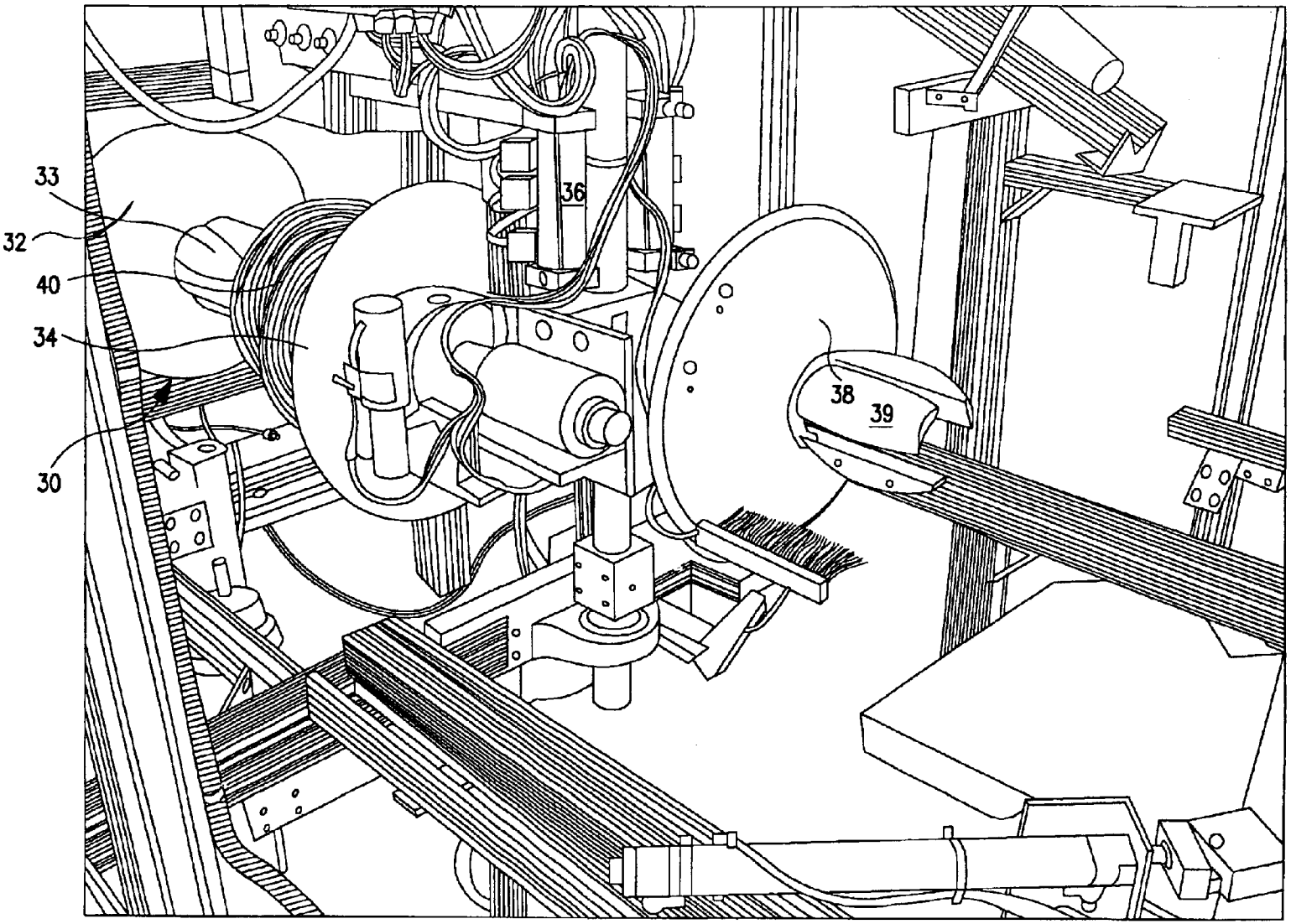
FIG. 1 shows a perspective view of the major components of the turret, including the coil winding station, and the payout tube insertion and packaging station according to a preferred embodiment of the present invention.

The turret assembly 36 shown in FIG. 1 is ready to rotate 180 degrees so that the wound coil 40 occupies the position of end form 38 and collapsible mandrel 39 and facing a wound coil loading station (not shown), but described below). In addition to mechanism for rotating the turret, the turret assembly also includes mechanism for controlling the collapsing and opening of the collapsible mandrels and for grasping and securing a fee end of the filamentary material for winding a coil. For the purposes of this invention it is understood that all such mechanism is known to to those skilled in the winding art.

Figure 2:
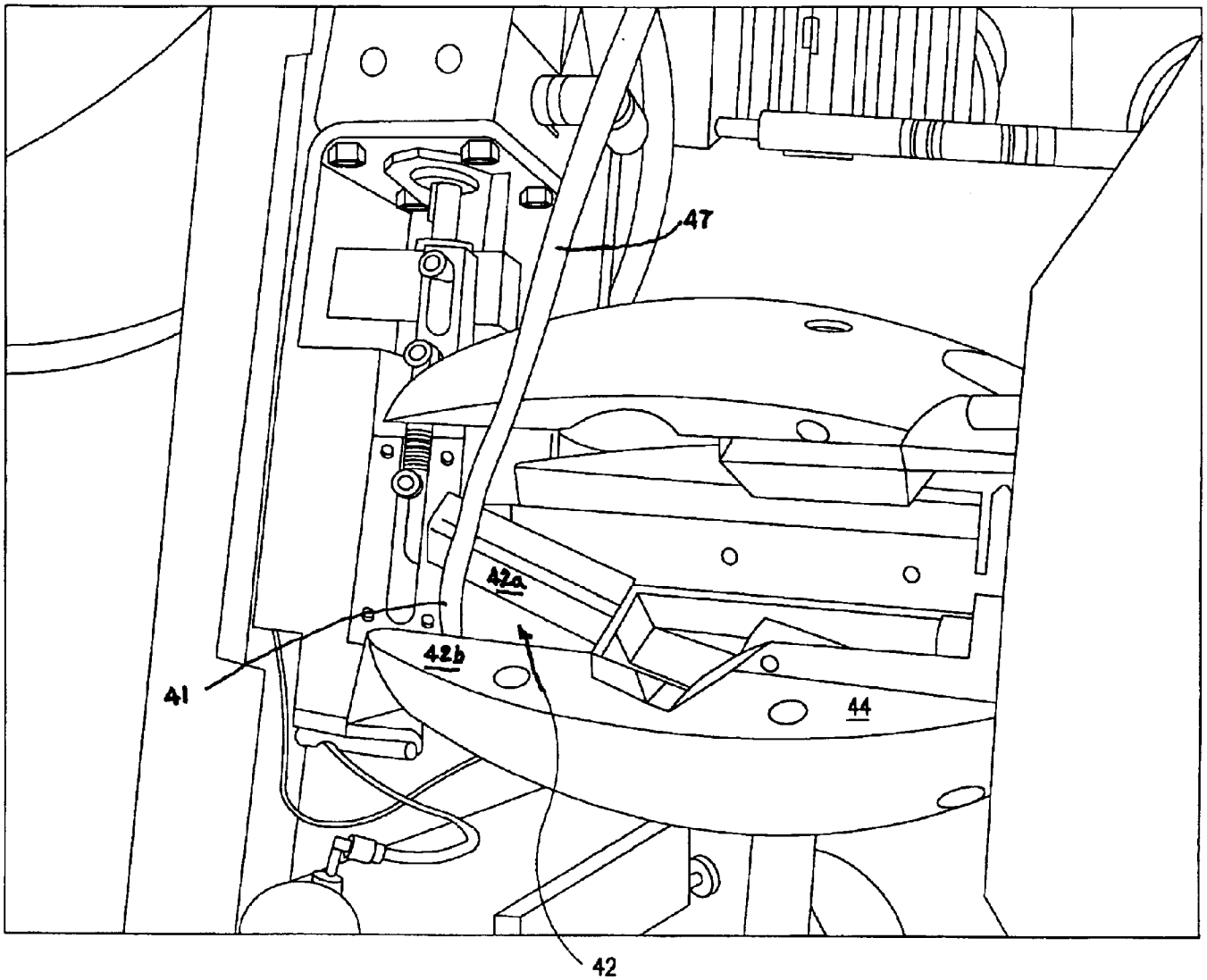
FIG. 2 shows the filamentary material entering the jaws of the opened clamp at the end of the collapsible mandrel as the mandrel and the end form are moved towards the filamentary material.
Figure 3:
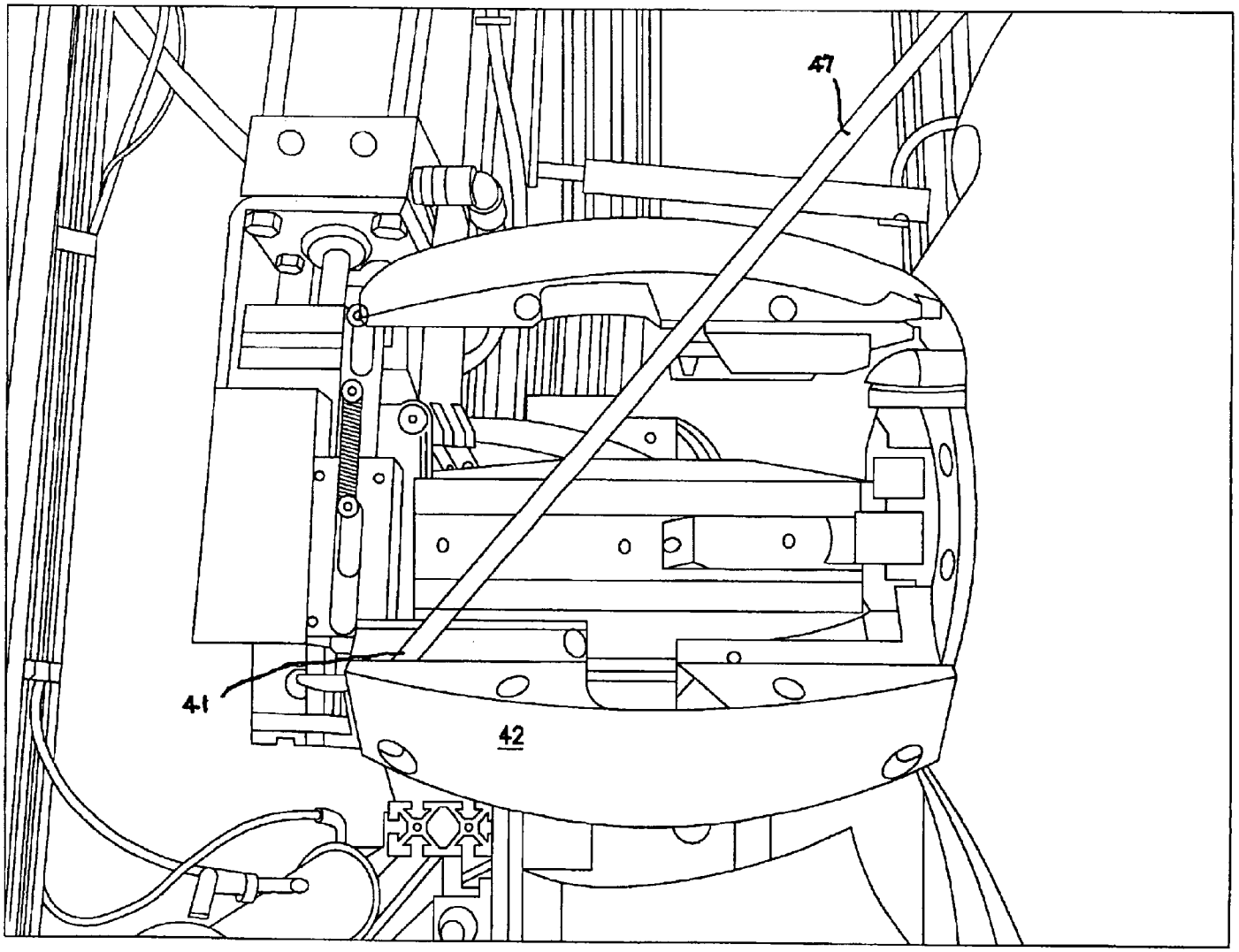

Once a coil has been wound, the end 41 of the coil 40 is grasped and severed by a mechanism and technique well known to those skilled in the winding art, and the free end 41 of the coil 40 is moved into the vicinity of the open jaws 42*a*, 4*b* of a clamping mechanism 42 shown in FIG. 2 and which is located on one end of a collapsible mandrel 44 as shown in FIG. 2. As shown in FIG. 3, the free coil end 41*a* is clamped between the jaws of the clamping mechanism 42 and the filamentary material 47 is pushed toward the end form 46*b* and a filamentary material grabber mechanism 49 as illustrated in FIGS. 5 and 6.

The following description is taken with respect to FIGS. 4–6. The entry of the collapsible mandrel 46 (with endform 46*c*) on the opposing mandrel 46*a* (with endform 46*b*) are shown as being moved into successively interleaving relationship as is respectively illustrated in FIGS. 5 and 6. The filamentary material is being pushed toward the latching mechanism 49 with the collapsible mandrels 46, 46*a* being further engaged as the second collapsible mandrel 46*a* is pushed into further engagement with the first collapsible mandrel 46. The filamentary material 47 is firmly engaged in the latch mechanism 49 at the base of the endform 46*b*. Collapsible mandrels 46, 46*a* are fully engaged as illustrated in FIG. 6.

As is more fully described hereinafter, once a wound coil is located at the boxing station and within a partially formed container, a payout tube is inserted through a top panel of the container having an appropriate payout tube hole located therein and into the radial hole formed in the wound coil so that a free end of the filamentry material is withdrawn through the radial hole and the payout tube whereby the filamentary material 47 can be unwound from the inside of the coil (the REELEX method, proprietary to Windings, Inc., and as represented by the above-mentioned patents).

FIG. 7 illustrates the plastic payout tube supply source used in the present invention and which comprises a number of stacked payout tubes 50 positioned on an inclined ramp 52 and retained by a gate mechanism 54 which is appropriately activated to enable a single plastic payout tube to be released to slide downwardly toward a payout tube retainer 52*a*, whereby each plastic payout tube 50 is held with the flange 56 thereof resting on top of the retainer 54 and the entrance 50*a* of the plastic payout tube 50 extending downward as is apparent when an individual tube within stacked tubes 50 slides down incline 52.

Each individual plastic payout tube 50 in retainer 54 is engaged by a payout tube insertion mechanism 58 located above the payout tube retainer mechanism (not shown) and is slid into the plastic tube 50 and which includes a movable fingers 60, 60*a* extending below the bottom of the payout tube 50 and immediately adjacent a fixed portion of the payout tube insertion mechanism 58 as illustrated in FIG. 8.

FIG. 9 is an explanatory view of the payout tube insertion mechanism 58 and an expanded mandrel 62 but absent the wound coil to illustrate the manner in which the payout tube insertion mechanism 58 coacts to achieve its purpose of deposition positioning the plastic payout tube 50 and simultaneously therewith is able to engage the free inner end of the wound filamentary material (not shown). The insertion of the payout tube insertion mechanism into and through the radial payout hole in the wound coil of filamentary material enables the movable rod 60 to squeeze the coil end against retention member 60*a* such that it may be extracted from the wound coil and through the payout tube, which is now engaged with the radial payout hole of the wound coil described with reference to FIGS. 14 and 16).

The unfolded containers 63 are stored in a box magazine 69*a* such as that illustrated in FIG. 10. The individual boxes containers are transported from a magazine storage area (not shown) to the boxing station 69 (described more fully below) via a number of vacuum suction cups (not illustrated) that engage an individual container and lift it to the boxing station 69 were where is is released onto the boxing station in position to be folded and receive the wound coil.

The boxing station 69 is shown in FIG. 11 and includes a floor member 70, a back member assembly 72 and a vertically movable ramp member 74 facing a collapsible mandrel (not shown), which in normal operation, would include a wound coil to be boxed. When an unfolded container is placed in the boxing station 69 by the previously described vacuum cups, a back panel 72*a* is lifted by engagement with back member 72 assembly so that it assumes a vertical position with a bottom panel (not shown) of the container resting on floor member 70. Movable front flap ramp member 74 serves to fold over the front flap of the container after the wound coil is inserted in the partially assembled container (not shown).

The partial view of boxing station 69 shown in FIG. 12 illustrates the wound coil 73 Positioned in partially formed contained 78 by rotation of the turret 36 and the associated end form and mandrel (FIG. 1, also reference mandrel 76 in FIG. 11) into confronting relationship with the boxing station, and more particularly movable ramp member 74. The mandrel 76 (FIG. 11) is lowered and the boxing station 69 moved forward so that the wound coil is inserted in the partially formed container 78 as shown in FIG. 12 with side panels 79 and 80 of the container 78 being raised as illustrated. One of the elements 81 for engaing the side panel 80 is shown in FIG. 12. A corresponding element exists on the opposite side of the container 78 for elevating side panel 79.

Back panel 72*a* of container 78 is shown in a vertical position resulting from the movement of back member assembly 72 as previously described with respect to FIG. 11. Top panel 83 of the container is shown with payout tube opening 84.

In FIG. 13 member 82 closes a top panel 83, including payout tube opening 84 of the container. Back panel 72*a* and member 81 are lowered thereby enabling member 85 to engage and support side panel 80. A similar element on the other side of the container supports side panel 79.

FIG. 14 illustrates the payout tube insertion mechanism 90 inserting a payout tube 92 in the tube opening 93 in the top panel 83 of the container and the radial opening in the wound coil (not shown). A typical plastic payout tube 92 is shown in FIG. 14A.

FIGS. 15 and 16 illustrate the manner in which the end of 100 of the wound coil 73 is grasped by fingers 102 of the payout tube and insertion mechanism 90 as it is withdrawn from the top panel 83. As shown in FIG. 16 member 82 prevents top panel 83 from lifting as the payout tube insertion mechanism 90 is raised.

In FIG. 17 the payout tube insertion mechanism 90 has cleared the payout hole in top panel 83 with the end 100 of the wound coil 73 grasped between fingers 102. In FIG. 18 a further top panel 104 is being bent over by member 106 (with the withdrawal of element 82) to secure the payout tube (not shown). Subsequently automatically operated gluing mechanisms glue appropriate portions of the side panels and the completed container is shown in FIG. 19 with end 100 of the wound coil projecting from the container 108, thereby enabling the filamentary material to be withdrawn through the radial opening and the payout tube.

It is desired that the present invention not be limited to the embodiments specifically described, but that it include all such modifications and variations that would be obvious to those skilled in this art. It is my intention that the scope of my invention should be determined by any and all equivalents of the various terms and structure as recited in the following annexed claims.

What is claimed is:

1. A machine for winding and boxing wound coils of filamentary material having a payout hole extending from the outer to the inner coil winding, comprising:

a. a turret mechanism mounting two oppositely disposed end forms and corresponding collapsible mandrels and operative between first and second stations, wherein said first station enables filamentary material to be wound on one of said mandrels and associated end form and a second station wherein the mandrel and end form containing the wound coil is rotated to confront a boxing station;

b. a boxing station including a platform having a movable back panel, a base panel and an inclined ramp facing said second station and being movable towards and away from said second station for receiving the wound coil from the collapsible mandrel containing the wound coil;

c. said boxing station receiving an unfolded container deposited on said base panel with a back panel of the container folded against said back panel and including means for folding two opposite side panels of the box to enable reception of the wound coil in the partially assembled box;

d. payout tube inserting means for inserting a payout tube in the payout hole of the wound coil through a payout hole in the top panel of the box and e. including means for grasping the free end of the wound coil and withdrawing it through the payout tube; and f. said boxing station further including means for folding, gluing and sealing the flaps of the container.

* * * * *